US006802755B2

(12) United States Patent
Walker et al.

(10) Patent No.: US 6,802,755 B2
(45) Date of Patent: Oct. 12, 2004

(54) LIGHT ILLUMINATED TOY DEVICE

(75) Inventors: Brian Walker, 21165 Scottsdale Dr., Bend, OR (US) 97771; Eddie Leung Wai Chor, Kwai Chung (HK)

(73) Assignee: Brian Walker, Bend, OR (US)

( * ) Notice: Subject to any disclaimer, the term of this patent is extended or adjusted under 35 U.S.C. 154(b) by 0 days.

(21) Appl. No.: 10/216,599

(22) Filed: Aug. 9, 2002

(65) Prior Publication Data

US 2004/0077264 A1 Apr. 22, 2004

(Under 37 CFR 1.47)

(51) Int. Cl.[7] ..... A63H 30/00
(52) U.S. Cl. ..... 446/175; 40/414
(58) Field of Search ..... 362/253, 806, 362/809, 811; 40/409, 411, 414; 446/175, 242, 71, 219, 236, 244, 484, 238

(56) References Cited

U.S. PATENT DOCUMENTS

| | | | | | |
|---|---|---|---|---|---|
| 3,805,049 | A | * | 4/1974 | Frank et al. | 240/10 R |
| 4,713,586 | A | * | 12/1987 | Chiang | 315/200 A |
| 4,852,283 | A | * | 8/1989 | Teng | 40/426 |
| 5,145,444 | A | * | 9/1992 | VanKuiken | 446/242 |
| 5,209,692 | A | * | 5/1993 | Coleman et al. | 446/71 |
| 5,247,218 | A | * | 9/1993 | Sven | 310/81 |
| 5,823,844 | A | * | 10/1998 | Markowitz | 446/175 |
| 6,001,433 | A | * | 12/1999 | Meng | 428/13 |
| 6,227,929 | B1 | * | 5/2001 | Nelson et al. | 446/239 |
| 6,305,818 | B1 | * | 10/2001 | Lebens et al. | 362/184 |

* cited by examiner

*Primary Examiner*—Derris H. Banks
*Assistant Examiner*—Jamila O Williams
(74) *Attorney, Agent, or Firm*—Smith-Hill and Bedell

(57) ABSTRACT

The present invention is a toy device that creates a visual illusion using a vibrating figure and strobe lighting. The user controls the strobe illumination frequency, as well as other potential aspects, to create different visual illusion effects.

20 Claims, 3 Drawing Sheets

LIGHT ILLUMINATED TOY DEVICE

TECHNICAL FIELD OF THE INVENTION

The invention relates to a toy illuminated with a light to create unique visual illusions.

BACKGROUND OF THE INVENTION

Toys displaying visual effects, such as movement and light, are popular with children of all ages. Children enjoy playing with toys displaying visual effects, and adults delight in the enjoyment of children at play with such toys. Moreover, adults themselves can enjoy playing with amusing and entertaining toys displaying movement and light.

Light emitting diodes (LEDs) are light devices that have a longer user-life compared to filament light bulbs. LEDs also use less electrical energy, are usually smaller, and can flash more rapidly than filament light bulbs. LEDs can also exhibit various visual and optical effects involving different colors, blinking rates, and flashing patterns.

One aspect of human visual perception that has given rise to a number of optical effects devices is the phenomenon of visual memory. It has been known for several centuries that human vision displays a persistence phenomenon. This persistence phenomenon is based on the fact that humans retain visual images for a brief period after reception of the image.

This persistence phenomenon allows humans to ignore the hundreds of times per day their eyelids blink. Further, the persistence phenomenon eliminates the detection of the on-off electric light cycling, or flashing at rates of 60 Hz (e.g. cycles per second) or faster. Perhaps the most widely recognized and obvious example of the visual persistence phenomenon is motion pictures (movies), where still pictures flash upon a screen at a rate of 60 images per second. Because of the display rate, the visual persistence phenomenon allows such images to be perceived by humans as a seamless blend of continuous motion. Another example of the persistence phenomenon is human perception of a rapidly spinning wheel, which can appear to slow down, stop spinning, and even reverse direction at various rotation speeds. The visual refreshment rate is variable, but, in general, humans begin to perceive flickering images at about 24 Hz (e.g. 24 images per second).

A strobe light can also create a "stop motion" visual effect as it flashes bright light on visual scenes in rapid succession. Harold Edgerton, a scientist and photographer at the Massachusetts Institute of Technology, perfected a technique in 1931 for high-speed and stop-motion photography using strobe lighting. Photographs using this technique show such scenes as a bullet piercing an apple or a light bulb shattering. Strobe lighting is currently used at various entertainment events.

Well known children's toys include the use of animated cartoon characters and toy figures. Animated dolls and toy figures are almost universally found in a child's toy collection. Dolls and toy figures of all sizes displaying life-like movement have fascinated children for decades and remain very popular with children in a wide age range.

Various mechanisms have been used to impart movement to toy figures. These mechanisms range from purely manual mechanisms, such as strings on puppets, to purely mechanical, such as a wind-up spring mechanism. Attempts to use very complicated electro-mechanical designs in children's toys, including computer control technology, have been met with very limited success.

Imparting life-like movement in small toy figures has also proven to be very difficult, if not impossible. The smaller the figure, the more difficult it is to construct with an internal mechanism to impart movement. Moreover, a smaller figure dictates a smaller, and consequently more delicate, internal mechanism with a correspondingly higher breakage rate. Further, the constraints on movement schemes has limited the ability of toys to emulate life-like motion. There remains a need for new innovations and techniques to impart realistic movement in small toy figures. Moreover, there is also a present need to impart variable motion of a figure in a toy device.

SUMMARY OF THE INVENTION

The invention takes advantage of human persistence phenomenon to create a toy figure displaying realistic, life-like, and variable movements. The toy has a shaft or handle with at least one semi-flexible figure affixed to the top of the handle and a globe covering and surrounding the area where the figure affixes to the handle. An electric motor within the handle vibrates the affixed figure, and a light emitting diode (LED) strobe generator illuminates the toy figure at a specified flashing frequency.

The handle features a control for adjusting the LED strobe frequency, as well as an on-off switch for the electric motor and LED strobe light. Alternative embodiments allow the user to also control the rate and direction of the figure's movement, the intensity of the LED, a selection of LED combinations or color of LEDs, and a selection of different toy figures for movement in the toy device.

During operation, the electric motor causes the affixed figure on the handle to vibrate rapidly and become visually indistinct. The appendages on the figure in the toy device, as well the figure itself, vibrate and gyrate at a very high frequency. The LED illuminates the vibrating figure with an LED generated light source, and by adjusting the frequency of the LED strobe flashing, the strobe frequency and vibration frequency can be synchronized to induce a stop-motion or slow-motion visual effect. When in proper synchronization, the vibrating figure can be adjusted to vary the visual impression including an appearance of dancing or movement in a life-like manner.

BRIEF DESCRIPTION OF THE DRAWINGS

The objects and features of the invention will become more readily understood from the following detailed description and appended claims when read in conjunction with the accompanying drawings in which like numerals represent like elements and in which:

FIG. 3A is a side view of a figure used in the

DETAILED DESCRIPTION OF THE PREFERRED EMBODIMENTS

Figure 1C:
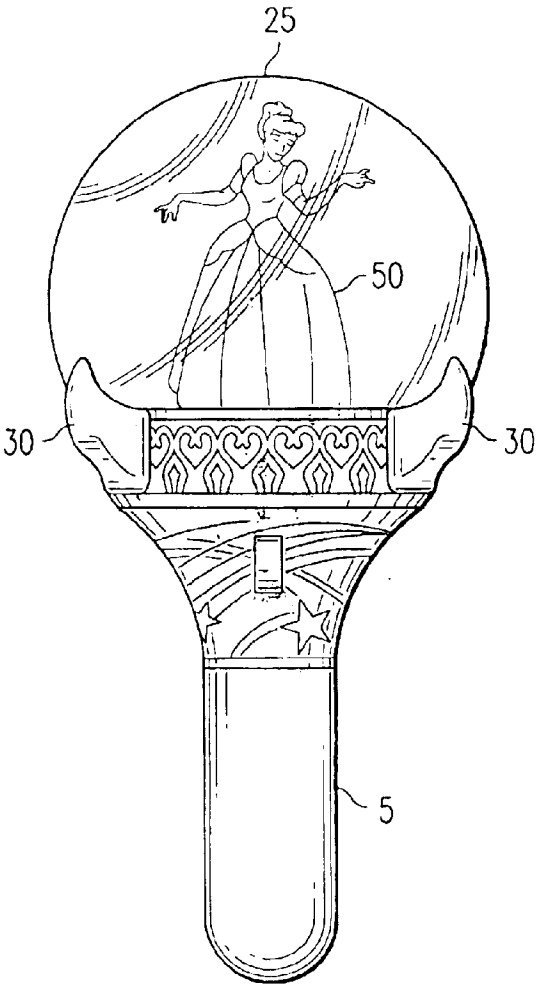
FIG. 1C is a back view of the toy device shown in FIG. 1A.
Figure 1B:
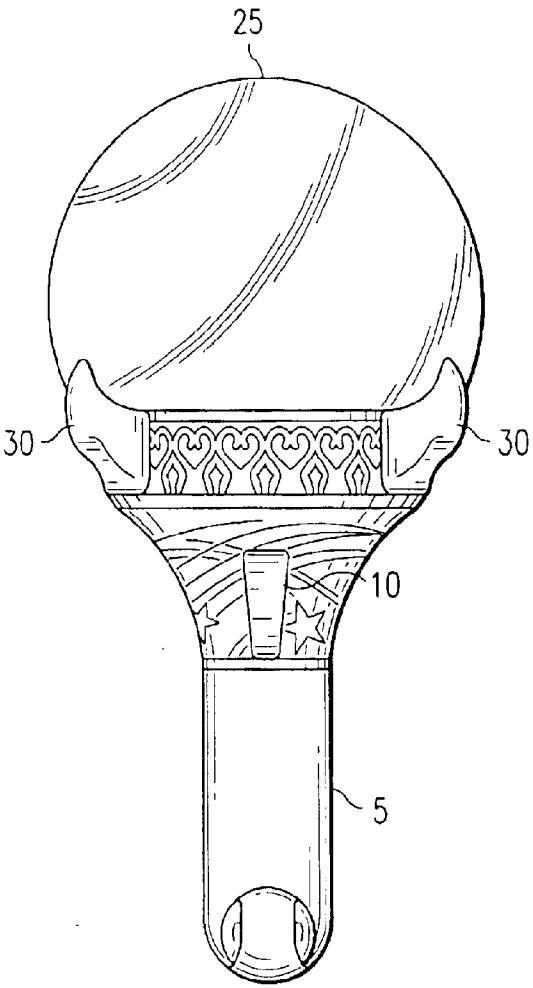
FIG. 1B is a front view of the toy device shown in FIG. 1A.
Figure 1A:
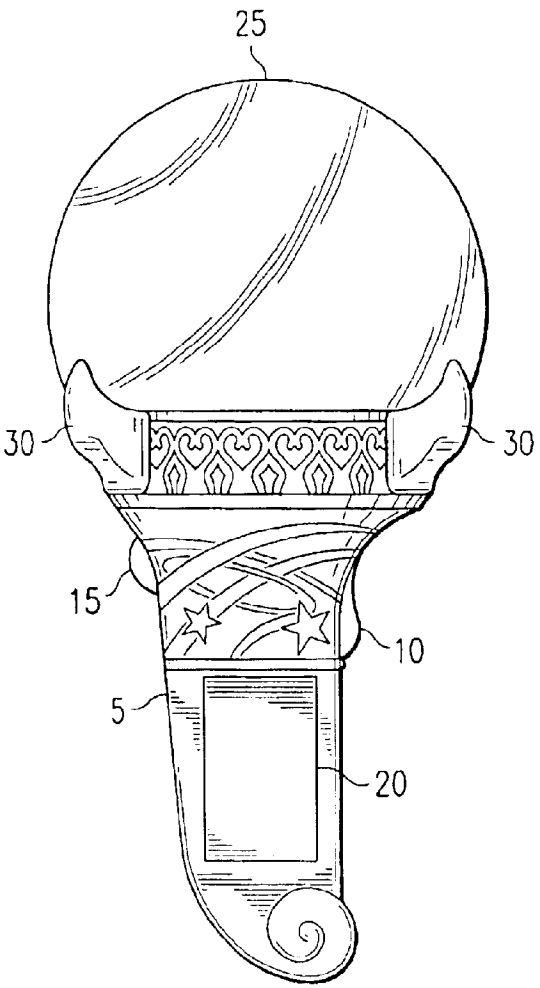
FIG. 1A is a side view of a light illuminated toy device embodying the present invention.

FIG. 1A shows a side view of the external configuration of the invention. The toy device has a handle or shaft 5. On the front of the handle 5, there is an on-off switch 10, and on the back, there is a thumb wheel 15. On top of the handle 5, there is an open-bottom, transparent globe 25 with hooks 30 to help hold the globe 25 in place.

The electrical components of the toy device are located inside the handle 5. These components include a power source (batteries), the LED timing or strobe circuit, and the vibration assembly. An access cover 20 provides access to the interior of the toy device to allow easy replacement of the batteries. The on-off switch 10 selectively opens and closes the electrical circuit powering the toy device's vibration assembly and the LED strobe circuit. This switch is normally controlled by a user's index finger when held in its usual manner. The thumb wheel 15 on the back of the handle 5 connects to a frequency controller element, preferably a variable resistor, which adjusts the flashing or strobe frequency of the LEDs on the toy device. The handle 5 itself is constructed of plastic or some other light-weight, rigid or semi-rigid material.

The transparent globe 25 attached to the top of the handle 5 permits the user to view the figure, which is protected by the globe 25. While the affixed figure can be viewed from many different perspectives or angles, a user holding the toy device will normally view the figure through the globe 25 from the backside of the toy device. The globe 25 has an open-bottom and may be secured to the handle 5 aided by the hooks 30. Alternatively, the hooks 30 may be part of a friction fit or some other fastening mechanism for globe 25, so the globe 25 can be selectively removed, providing access to the top of the handle 5 and permit the user to interchange a number of different figures.

FIG. 1B shows a front view of the toy device. The front of the handle 5 includes the on-off switch 10 that controls the electric circuit located inside the handle 5. This on-off switch 10 is normally operated by the index finger of the user. In normal usage, the front of the toy device faces away from the user.

A back view of the toy device is shown in FIG. 1C. The handle 5 includes the thumb wheel 15, which controls the LED strobe frequency. On the top of the toy device is an open-bottom, transparent globe 25. Inside the globe 25, there is a toy device figure 50 attached to a vibration assembly mounted inside the handle 5. While the figure can be viewed from many different angles, a usual viewing perspective of the figure is from the backside of the toy device. The hooks 30 on the side of the handle 5 help secure the globe 25 to the handle 5.

In the embodiment described herein, the handle 5 will ideally be between 4.5" to 5" in length, 1" to 1.25" wide, and 1.5" to 1.75" in depth. The globe 25 will ideally be between 3" to 4" in diameter. Although not critical to the visual illusion of the invention, these dimensions provide a preferred base-line for the intended use of the toy device.

Figure 2:
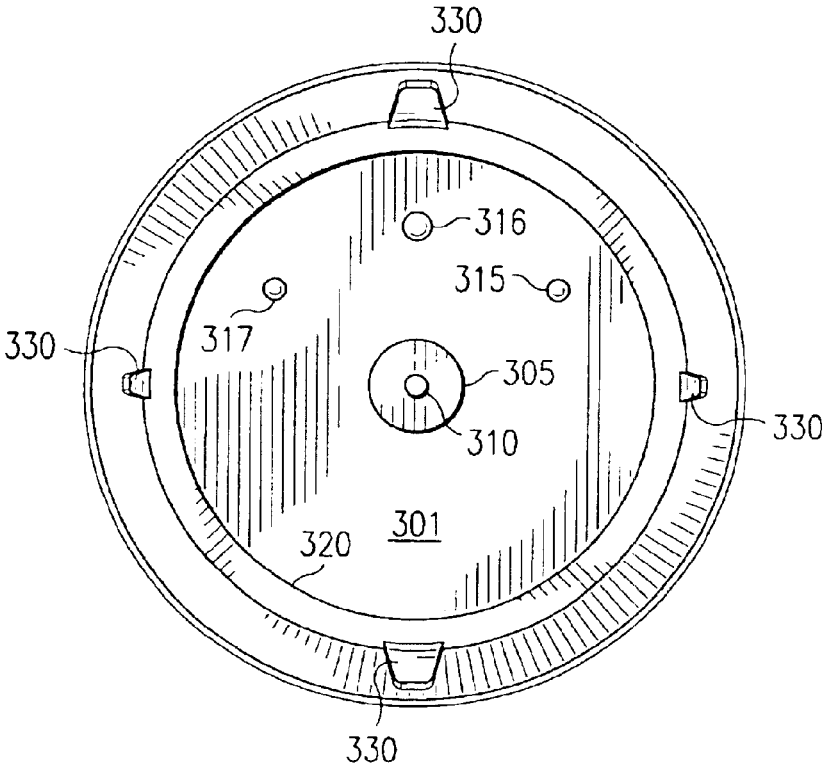
FIG. 2 is a top view of the platform of the toy device without the figure or external globe.

A top view of the handle 5 with the globe 25 removed is shown in FIG. 2. A platform stage 301 is the top surface of the handle 5. In the center of the platform stage 301 is a circular opening 305 into the interior of handle 5 of the toy device. Extending from the opening 305 is a post 310 attached to the vibration assembly located inside the handle 5 of the toy device. The figure 50 (not shown) can be attached to the post 310 securing the figure to the vibration assembly mounted inside handle 5.

On the platform stage 301 are three light emitting diodes (LEDs) 315, 316, and 317 arranged in a 90° arc centered around the opening 305. The LEDs 315, 316, and 317 emit the strobe light directed to the figure positioned on post 310. By illuminating LEDs 315, 316, and 317, the visual illusion of movement in the affixed figure 50 (not shown) on post 310 is created. Although three LEDs 315, 316, and 317 in an arc provide good overall illumination in this embodiment, a different number of LEDs may be used. The LED(s) may illuminate the figure in an arc from as small as 30° relative to the center of the front of the figure to a full 360° arc. For example, eight LEDs could be arranged to completely illuminate the entire figure, or a number of arrays of two or more LEDs in different colors may be arranged around the figure Additional controls on the handle 5 can be used to control which combination of LED arrays illuminate, vary the angle of illumination, or vary the color of illumination.

The LEDs 315, 316, and 317 should be positioned between 0.75" and 1.5" , preferably between 1" and 1.35", from the figure to obtain the optimal visual effect of the illusion. Other configurations can be used in the toy device without departing from the spirit of the invention. For example, the distance of the LEDs can be varied to vary the visual illusion. One or more of the LEDs can also be elevated above the stage platform 301. Moreover, LEDs can be placed on the globe 25 and direct light toward the figure from the front, side, or top of the globe 25. The hooks 330 may also contain LEDs for illuminating the figure.

The outer edge 320 of the stage platform 301 is a raised lip or wall in which the open-bottom globe 25 fits. This outer edge 320 in the preferred embodiment is designed for permanently securing the globe 25 in place. Alternatively, this outer edge 320 may comprise screw-like threads or a surface enhancing a friction fit removably securing the globe 25 to the toy device. The hooks 330 also provide additional support and protection and enhance attachment.

Figure 3A:
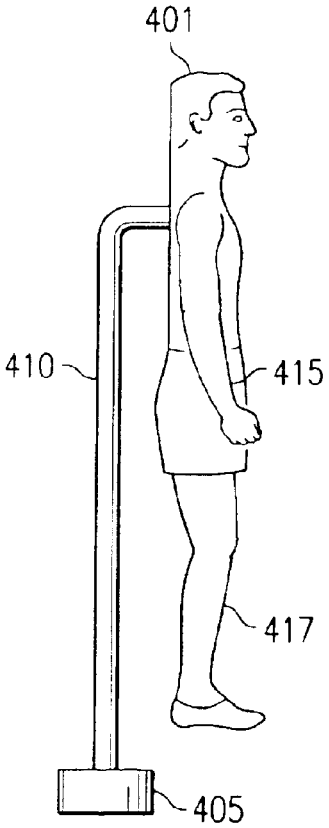

FIG. 3A shows a side view for an embodiment of a figure 401 used in the invention. Viewed from the side, the figure 401 is flat and made from a soft, semi-flexible material, such as rubber, which readily vibrates. The figure 401, however, may also be constructed of a rigid or semi-rigid material. A base 405 attaches to the post 310 (FIG. 2) securing the figure 401 to the vibration assembly inside the handle 5 of the toy device.

A rigid metal or hard plastic mounting bracket 410 extends upwardly from the base 405 into the back of the figure 401. The base 405 connects directly to the vibration assembly by the post 310 (FIG. 2) to impart the maximum amount of vibrating motion to the mounting bracket 410. By attaching the mounting bracket 410 to the back of figure 401, the arms 415 and feet 417, or any other appurtenances or appendages, freely respond to the vibration. Alternatively, the mounting bracket 410 can also be attached to other placements on the figure 401 to vary the movement of the figure 401.

Figure 3B:
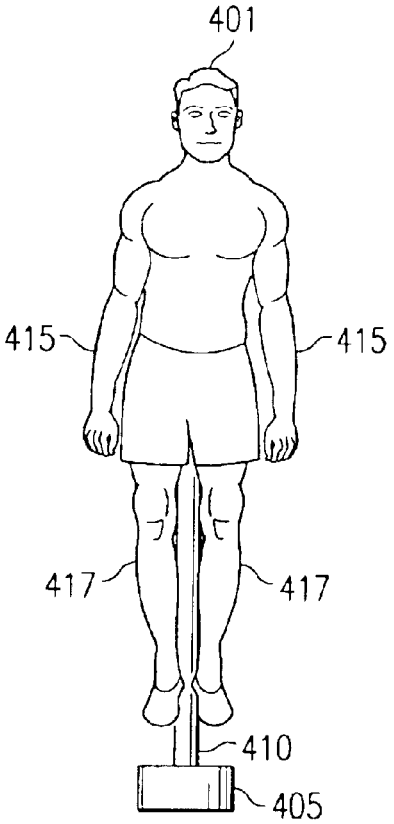
FIG. 3B is a front view of a figure used in the toy device.

FIG. 3B is a front view of the figure 401. The figure 401 has two arms 415 and two legs 417. The base 405 connects to the figure 401 using a rigid mounting bracket 410 extending from the base 405 up to the mid-level of the back of the figure 401, where it attaches to the back of the figure 401. During operation, the vibration from the vibration assembly causes the arms 415 and legs 417 to vibrate and gyrate along with rest of the body of figure 401.

Other alternative embodiments for the figure 401 include a base with multiple figures attached to the mounting bracket 410 or base 405. Other whimsical objects, such as balls or rocketships, may be placed on the mounting bracket 410 or base 405. A figure can also be used designed for viewing from a full 360° angle, with the mounting bracket 410 extending up through the bottom of the figure. Another embodiment can vary the type of movement of the figure to include slowly rotating the figure or rapidly twirling the figure The figure 401 may also be permanently mounted, or the figure 401 may be removably affixed allowing a multitude of figures to be attached to post 310 of the toy device. A flexible mounting bracket, such as a spring, may be used to dampen the vibration imparted to the figure 401.

Figure 4:
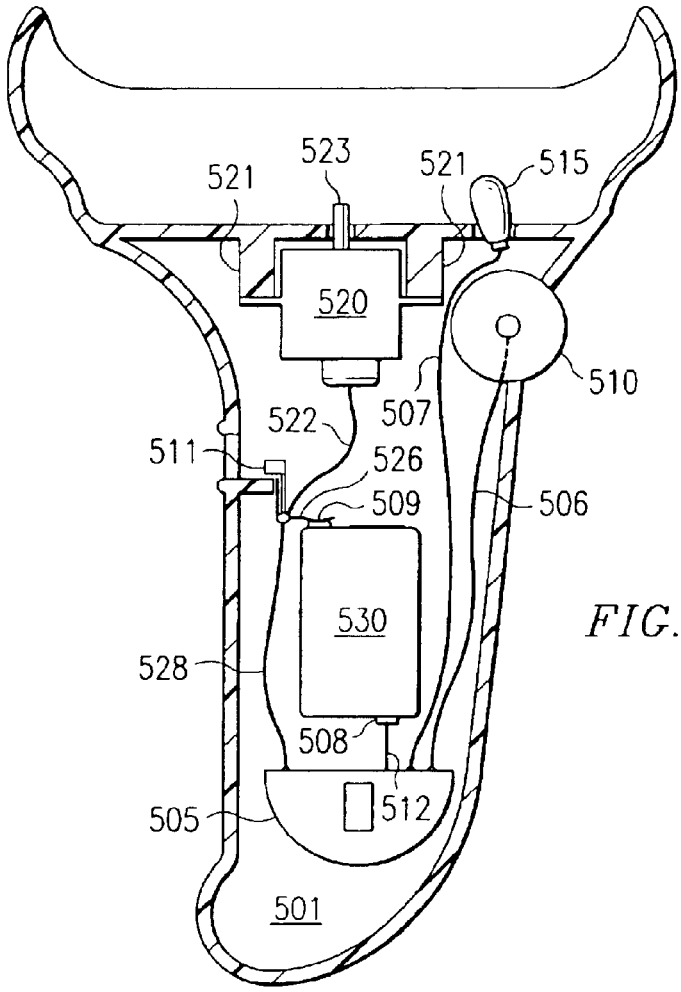
FIG. 4 is an internal view of the handle used in the toy device.

FIG. 4 shows a side sectional view revealing the interior of the handle 5 in the toy device. The handle body 501 is hollow and constructed of a rigid, or semi-rigid, light-weight material such as plastic. An electrical strobe circuit board 505 is mounted in the handle 501. The thumb wheel 510 adjusts a frequency control element connected to the circuit board 505 by electrical connector 506. The strobe circuit board 505 also connects to the LED 515 (or LED combination) by electrical connector 507. Although only one LED 515 is shown, more than one LED can be connected with each other or in series to the strobe circuit board 505.

The electrical circuit is also connected to a power source, such as two AA-size electric batteries, at electrical terminal 509. The power source (not shown) are isolated from the actual internal electrical components and mechanism by a molded cavity or covering 530. The electrical connector 526 connects the positive terminal 509 from the power source. An electrical connector 512 connects the ground terminal 508 of the batteries to the strobe circuit board 505.

The electrical circuit and terminal 509 provide power to the vibration assembly 520. The vibration assembly 520 mounts within the handle 501 using soft-mounts 521 that do not firmly anchor the vibration assembly to the handle 501. This mounting configuration does not excessively restrict vibration. The mounting scheme surrounds the vibration assembly 520 with soft-mounts 521 to provide amble space for the vibration assembly 520 to impart vibration movement to the figure.

A post 523 extends upward from the vibration assembly 520 and fits into the base 405 (FIG. 3A) of the figure 401 (FIG. 3A). An on-off switch 511 selectively turns both the vibration assembly 520 and the strobe LEDs 515 on and off. Alternatively, a separate on-off switch or variable switch can also be provided for the vibration assembly 520 and the LEDs 515.

The on-off switch 511 connects to the vibration assembly by electrical connector 522 and to the strobe circuit board 505 by electrical connector 528. The on-off switch 511 also connects to the terminal 509 over electrical connector 526.

In operation, the operator activates the on-off switch 511 to provide electrical power to the strobe circuit board 505, LEDs 515, and the vibration assembly 520. The vibration assembly 520 consists of an electric motor rotating an off-center weight. When powered, the rotating off-center weight causes vibration. A figure (not shown) attached to the post 523 rapidly vibrates in response to the electric motor rotating the off-center weight and causing vibration of the post 523 in the vibration assembly 520. The vibration frequency depends upon the mass of the rotating weight, the rotation speed of the motor, the mass of the character, the rigidity of the soft-mounts 521, and the degree of freedom of movement within the handle 501. Other types of vibration assemblies can be used and are contemplated by the invention. A variable control can also be used to modify the rate of vibration, and other controls can be added to control the direction of the figure's movement.

As a figure attached to the post 523 vibrates, the LEDs 515 illuminate the FIG. These LEDs 515 are positioned between 1" and 1.25" from the attached figure to achieve the optimal visual effect. The electrical circuit for the LEDs 515 includes the circuit board 505, which produces an oscillating, pulsing electric current causing the LEDs 515 to intermittently illuminate and produce strobe lighting.

The thumb wheel 510 connected to the circuit board 505 by electrical connector 506 adjusts the frequency of the LEDs 515 illumination. Preferably, the thumb wheel 510 adjusts a variable resistor to vary the strobe frequency or, alternatively, the thumb wheel 510 may adjust a variable capacitor (not shown). The LEDs 515 in turn illuminate the figure, such as figure 50 (FIG. 1C) and 401 (FIG. 3A), with the variable frequency strobe light.

A toy device user can adjust the frequency of the strobe LEDs 515 using the thumb wheel 510. By synchronizing the strobe frequency of the LEDs 515 with the frequency of vibration, a rapidly vibrating figure 50 (FIG. 1C) or 401 (FIG. 3A) can be illuminated with the strobe lighting and create the illusion of variable movement. This visual illusion is the result of the persistence phenomenon of human vision.

Variable visual effects can be created by deftly varying the frequency of the flashing LEDs 515. The vibrating illuminated figure 401 (FIG. 3A) or 50 (FIG. 1C) can appear to be dancing or moving by varying the frequency of the strobe LEDs 515 using the thumb wheel 510. Looking at figure 401 (FIG. 3A), the arms 415 and feet 417 can be made to appear to sway back and forth and up and down relatively slowly. Adjustment of the thumb wheel 510 can even "freeze" the figure 401 (FIG. 3A) in place.

Alternative embodiments can also be used in the invention. A control can be added to control the speed of rotation of the electric motor, varying the vibration frequency of the vibration assembly 520. Rather than rotating an off-center weight, the electric motor in the vibration assembly 520 may rotate an off-center cam which would vibrate the figure in a different manner. Although three LEDs 515 arranged in a 90° arc provide adequate illumination from a frontal aspect, more LEDs may be provided, including different colored LEDs to create different lighting effects. Moreover, an array of multiple LEDs 515 may be used to provide illumination over a greater aspect of the figure up to a full 360° range. Additional electrical components can also be added to provide sound and create one or more musical tunes.

Figure 5:
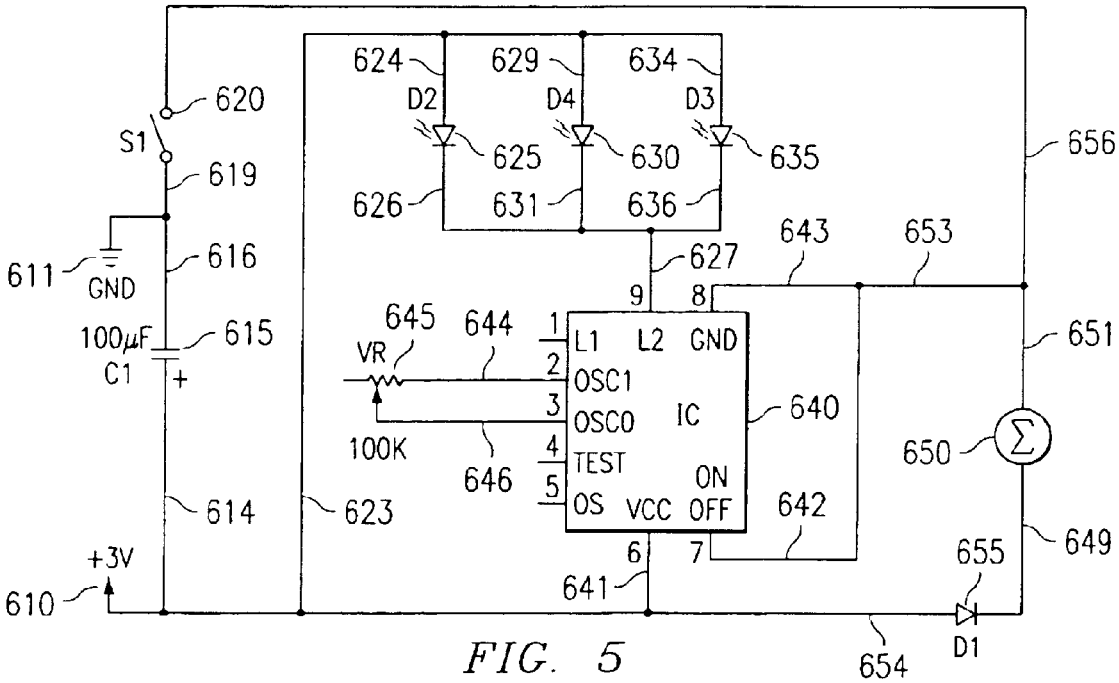
FIG. 5 is an electrical schematic of the motor and strobe circuit used in the toy device.

FIG. 5 shows one electric circuit used in the embodiment. The power source 610 is a 3-volt source connected to a ground connector 611 through connector 614, capacitor 615, and connector 616. In the preferred embodiment, the power source 610 consists of two size-AA batteries connected in series and delivering 3 volts of power. Connected to the power source by connector 614 is a 100 $\mu$F. capacitor (C1) 615. The capacitor 615 connects to the ground 611 by connector 616. An on-off electrical switch (S1) 620 selectively provides power to the circuit and connects to the ground 611 by connector 619.

Three LEDs are shown connected to the power source 610 by connection 623. LED D2 625, LED D4 630, and LED D3 635 connect to an integrated circuit (1C) 640 at L2 (pin 9). LED 625 is coupled to connector 623 and connector 624. LED 630 is coupled to connector 623 and connector 629. LED 635 is coupled to connector 623 and connector 634. The LEDs 625, 630, and 635 connect to connector 627, which connects to the integrated circuit 640. LED D2 625 is coupled to connector 627 and connector 626. LED D4 630 is coupled to connector 627 and connector 631. LED D3 635 is coupled to connector 627 and connector 636.

The integrated circuit (1C) 640 generates an oscillating signal required to generate the strobe effect. The integrated circuit 640 shown possesses 9-pins for connection within the circuit and operation. Power is supplied to the integrated circuit 640 through connector 641 to the VCC (pin 6), which is coupled to power supply 610. The power supply provides a Vcc power source.

A variable resistor (VR) 645, providing between 5,000 and 100,000 ohms resistance, is coupled to the integrated circuit 640 by connector 644 to the OSC1 (pin 2) and connector 646 to OSCO (pin 3). This variable resistor 645 controls the frequency of illumination of the LEDs 625, 630, and 635.

A feedback loop 642 is coupled to connectors 643 and 653. This feedback loop 642 provides a reference voltage and current to regulate the current oscillation of the integrated circuit 640.

An electric motor 650 creates the vibration in the toy device. The electric motor (M) 650 is coupled to the power supply 610 through connector 654, diode 655, and connector 649. Connector 654 is also coupled to the integrated circuit 640 via the junction of connector 641 and connector 654. The diode (D1) 655 controls the direction of current flow from connector 654 through connector 649 to the motor 650. The motor 650 is also coupled to the switch 620 by connector 656 and connector 651, and also connects to connector 653 and connector 643 and the ground (pin 8) on the integrated circuit 640.

In operation, closing the switch 620 completes the electrical circuit connection permitting current to flow and energize the motor 650, the integrated circuit 640, and the LEDs 625, 630, and 635. The rotating motor 650 vibrates the figure The LEDs 625, 630, and 635 flash intermittingly at the oscillation frequency set by the current generated by the integrated circuit 640. The operator controls the oscillation frequency of current generated by the integrated circuit 640 flowing to the LEDs 625, 630, and 635, and the associated rate of intermittent illumination, by adjusting the variable resistor 645.

Controlling the frequency of the current oscillation enables the operator to create and control the illusion of variable movement. Another alternative is to leave the strobe light frequency constant and adjust the vibration frequency to achieve the desired visual effects. Other alternate embodiments can include control over the direction of the figure's movement, the intensity of the LEDs, and different colored LEDs.

While the invention has been particularly shown and described with respect to preferred embodiments, it will be readily understood that minor changes in the details of the invention may be made without departing from the spirit of the invention. Having described the invention, I claim:

What is claimed is:

1. A toy device comprising:

a body, a vibration assembly located in said body with a connector member extending out of the vibration assembly and activated by a switch, an object attached to the connector member, said object vibrating when the vibration assembly is operating, and at least one light source illuminating said object with a strobe effect.

2. A toy device according to claim 1, wherein the light source illuminates the object at an illumination frequency and the toy device further comprises an accessible control setting a variable component to vary the illumination frequency.

3. A toy device according to claim 1, wherein the light source illuminates the object at an illumination frequency, the vibration assembly vibrates the object at a vibration frequency, and the toy device further comprises an accessible control for varying at least one of the illumination frequency and the vibration frequency.

4. A toy device according to claim 1, wherein the light source illuminates the object at an illumination frequency, the vibration assembly vibrates the object at a vibration frequency, and the toy device further comprises one or more accessible controls coupled to one or more variable components respectively to set the illumination frequency and the vibration frequency.

5. A toy device according to claim 1, wherein the light source comprises light emitting diodes positioned between 0.75 inches and 1.5 inches from the object.

6. A toy device according to claim 1, wherein the light source comprises different colored light emitting diodes.

7. A toy device according to claim 1, wherein the object is illuminated in an arc covering from a 30° to a full 360° arc relative to the center of the front of the body.

8. A toy device capable of creating a visual illusion comprising:

a body with a top, a bottom, and sides, said top having an aperture, a connector member extending from said aperture in the top of said body, a vibration assembly mounted within the body and coupled to said connector member so as to vibrate said connector member, an object attached to said connector member such that the object is vibrated by the connector member and vibration assembly, a strobe light source illuminating the object with at least one light source radiating toward the object, and at least one control accessible on the body capable of adjusting the visual illusion.

9. A toy device according to claim 8, wherein the strobe light source comprises at least one light emitting diode illuminating the object with an intermittent illumination.

10. A toy device according to claim 8, wherein the strobe light source comprises one or more colored light components.

11. A toy device according to claim 8, wherein the vibration assembly can vary the vibration frequency of the connector member.

12. A toy device according to claim 11, comprising a controller for varying the frequency of vibration to create the illusion of slower movement of the vibrating object.

13. A toy device according to claim 8, wherein the object rotates around an axis extending perpendicular from the plane of the top of the body.

14. A method of operating an illuminated toy device comprising the steps of:

providing a object made of a semi-flexible material, attaching said object to a vibration assembly using a connector member extending from the vibration assembly, said vibration assembly including a motor, vibrating the object using the vibration assembly, and illuminating the object with a strobe light source providing a visual effect through intermittent illumination.

15. A method according to claim 14, wherein the strobe light source is at least one light emitting diode.

16. A method according to claim 14, wherein the strobe light source is controlled by the user to vary the illumination frequency.

17. A method according to claim 14, wherein the intermittent illumination is controlled using a variable resistor.

18. A method according to claim 14, wherein the strobe light source includes a colored light source.

19. A method according to claim 14, further comprising the step of varying the frequency of vibration of the object using a controller in an electric circuit.

20. A method according to claim 14, further comprising the step of varying at least one of the frequency of strobe light intermittent illumination and the frequency of object vibration to create the illusion of variable movement of the vibrating object using at least one controller.

* * * * *